US006110001A

United States Patent [19]

Chae

[11] Patent Number: 6,110,001

[45] Date of Patent: Aug. 29, 2000

[54] ANIMATED TOY DOLL

[75] Inventor: John W. Chae, Flower Hill, N.Y.

[73] Assignee: Hosung NY Trading Inc., Brooklyn, N.Y.

[21] Appl. No.: 09/086,571

[22] Filed: May 29, 1998

[51] Int. Cl.[7] ..... A63H 13/02; A63H 3/31

[52] U.S. Cl. ..... 446/339; 446/183; 446/193; 446/301; 446/395

[58] Field of Search ..... 446/183, 184, 446/185, 188, 192, 193, 197, 198, 297, 301, 337, 339, 340, 372, 379, 395

[56] References Cited

U.S. PATENT DOCUMENTS 957,819 5/1910 Ulbrich .
3,195,269 7/1965 Weih et al. .
3,210,887 10/1965 Glass et al. .
3,237,344 3/1966 Ostrander .
3,924,351 12/1975 Terzian .
4,294,033 10/1981 Terzian .

*Primary Examiner*—Robert A. Hafer
*Assistant Examiner*—Laura Fossum
*Attorney, Agent, or Firm*—Birch, Stewart, Kolasch & Birch, LLP

[57] ABSTRACT

An animated toy doll having a substantially hollow head and an adjoining body, said head containing external facial features which include a mouth, said animated toy doll housing an operating device which comprises a pair of levers which are hinged together at one end position thereof and held apart by a biasing spring means disposed at the other end portion thereof, and connecting means extending from said one end portion of said pair of levers to the vicinity of the mouth of the doll, whereby, upon compressing the pair of levers against the bias of the spring, the connecting means pulls against the mouth, causing a desired change of expression in the facial features.

8 Claims, 2 Drawing Sheets

ANIMATED TOY DOLL

BACKGROUND OF THE INVENTION

1. Field of the Invention

The present invention relates to an animated toy doll and more particularly to an improved animated toy doll which generates simulated voice and lip movements through manual manipulation.

2. Description of the Related Art

Various types of toy dolls that produce sounds and simulated speaking or sucking are known in the art.

U.S. Pat. Nos. 1,324,730; 3,005,283 and 4,244,139 disclose a movable mouth structure controlled by a biased pliers-type arrangement wherein the handles of the pliers are located inside the body of the figure for manipulating the movements of the upper and lower lips. These patents do not disclose the synthesized sounds.

U.S. Pat. No. 3,195,268 discloses a device for operating the mouth which is powered by a spring motor and triggered by the operator changing the orientation of the figure toy from a horizontal to a vertical position. The mechanism does not produce synthesized sounds.

U.S. Pat. No. 3,261,124 discloses a doll having lips that move as sounds are produced from a phonograph record. The doll has a flexible, unsupported head. The doll's lips are attached at a single place to a spring mechanism, so that movement of the spring pulls the lips in and pushes them out in a simulation of talking. The end of the spring opposite to the lips is connected to a rod that moves up and down with the rotation of an eccentric disk.

U.S. Pat. No. 3,364,618 discloses a doll with a flexible, unsupported head, movable eyes, movable lips and a phonograph record that produces speech sounds. To simulate talking, the doll's lower lip is pulled with a flexible wire, the wire being attached at its opposite end to a rockable member.

U.S. Pat. No. 4,775,352 discloses a doll with two motors that drive, respectively, movable eyes and movable lips. Each lip has a rod for moving the lip into open or closed position. An external camp with a tracking groove and a cam follower having a pin that rides the groove are used to move the two rods. The operation of the motor coupled to the lips and the playing of a tape that produces sounds have coordinated timing.

U.S. Pat. No. 4,808,242 discloses a doll having a flexible head, an integrated circuit that produces synthesized speech, an internal cam and a pivotable cam follower. An end of the cam follower pushes a lower lip to simulate talking, but is not attached to the lips. The doll's head is self-supporting, and all the mechanical and electrical workings of the doll are contained in the head.

U.S. Pat. No. 4,869,703 discloses a driving mechanism for an animated toy having two pieces that are individually mounted to the toy's lips, an oscillating piece that directs lip movement and a housing that includes a head portion. The mechanism does not provide synthesized speech sounds.

U.S. Pat. No. 5,413,516 discloses a toy doll with lips that move as speech sounds are produced from a speaker, by pressing a button and activating an integrated circuit that sends voice signals to the speaker.

A review of the above patents will show that the doll devices disclosed therein are too complicated in structure to become a commercial and practical product. Also, in the animated toy doll of the present invention, the lips move in a substantially different manner than is the case with the conventional art. More specifically, the lips of the present invention are pulled toward the inside of the mouth while they are closing. This movement more realistically represents the actual movement of the lips, whereas the mouth movement of the prior art is more artificial in nature, similar to chattering teeth.

SUMMARY OF THE INVENTION

Accordingly, it is an object of the present invention to provide an improved animated toy doll which eliminates the above problems encountered with conventional lip-moving toy dolls.

Another object of the present invention is to provide an animated toy doll, for example, a monkey doll, which contains a device for easily and effectively moving its mouth and creating a sound by squeezing the body thereof.

A further object of the present invention is to provide an animated toy doll including a base lever and a pivotal lever pivotally connected to the base lever, a spring and a squeaker, both disposed between end portions of the base and pivotal levers, and a connecting element, e.g., a string connected to the upper portion of the pivotal lever and to a throat connector disposed in the mouth of the doll for generating sound and actually moving the mouth by squeezing or pushing the abdomen or body of the doll.

Still another object of the present invention is to provide an animated toy doll which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to an animated toy doll having a substantially hollow head and an adjoining body, said head containing external facial features which include a mouth, said animated toy doll housing an operating device which comprises a pair of levers which are hinged together at one end position thereof and held apart by a biasing spring means disposed at the other end portion thereof, and connecting means extending from said one end portion of said pair of levers to the vicinity of the mouth of the doll, whereby, upon compressing the pair of levers against the bias of the spring, the connecting means pulls against the mouth, causing a desired change of expression in the facial features.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Referring now in detail to the drawings for the purpose of illustrating preferred embodiments of the present invention, the animated toy doll as shown in FIGS. 1 to 4 comprises a monkey toy doll 21 and an operating device 10 disposed on the inside of the monkey.

Figure 1:
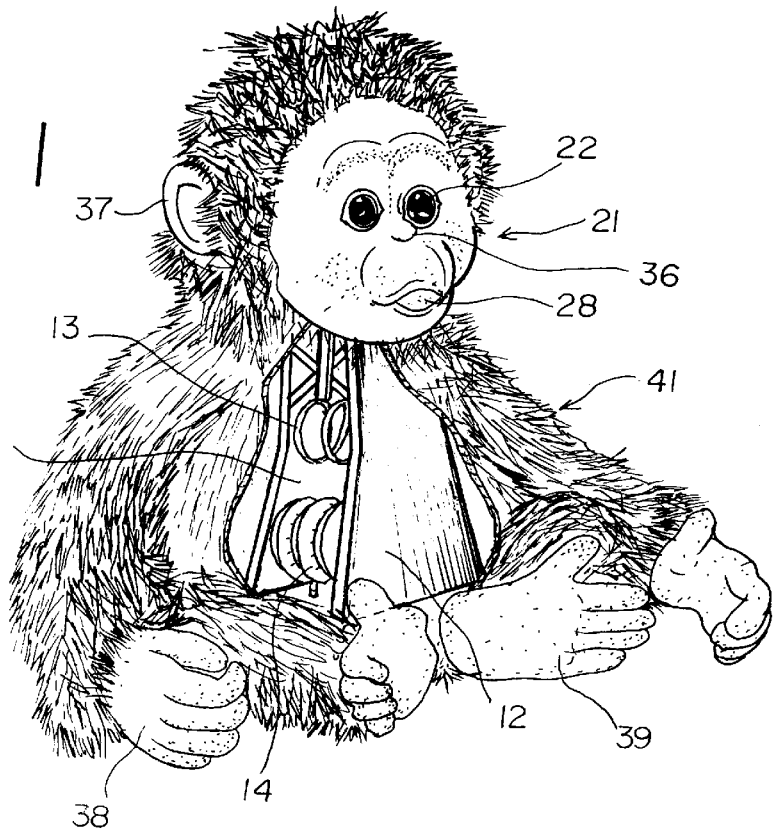
FIG. 1 is a perspective view of an animated monkey toy doll of the present invention containing a cut-away portion for illustrating the construction of the operating device for the toy doll according to the present invention.
Figure 2:
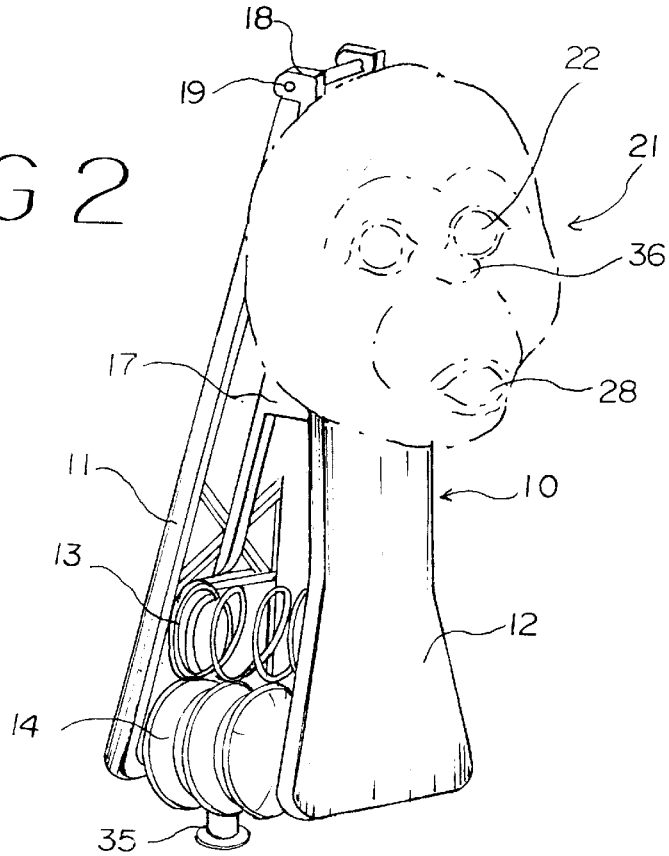
FIG. 2 is a perspective view of the operating device of the animated toy doll according to the present invention.

As shown in FIGS. 1 and 2, the monkey toy doll includes a face member 21 made of a soft vinyl material. The face member 21 contains a mouth 28 having a pair of lips 30, a pair of eyes 22 disposed in a pair of holes 33, a pair of ears 37, and a nose 36. Each eye 22 is supported on an eye seat 32. The face member 21 is fixed on a body member 41 having a pair of hands 38 and a pair of legs 39.

Referring in detail to FIG. 2, the operating device 10 includes a base lever 11 and a pivotal plate lever 12 pivotally connected to the base lever 11 through a pivot pin 19. The pivot pin is supported on the top end portion of the base lever 11 for slidable insertion into a pivotal aperture 18 of the pivotal plate lever 12. A spring 13 and a squeaker or bellows 14 having a squeaker nozzle or mouth 35 are disposed between the lower portions of the base and pivotal plate levers 11 and 12.

The base lever 11 has an upper extension member 16 which extends toward the face member 21 for tightly receiving a pair of eye supports 32 supported on a pair of grooves 40 and a middle extension 17 which extends toward and is secured to face member 21 using aperture 34 disposed therein.

Figure 3:
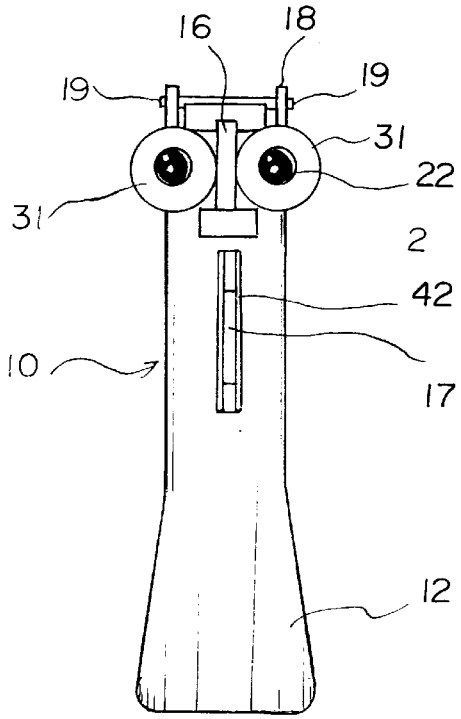
FIG. 3 is a front elevational view of the operating device of FIG. 2.

The pivotal plate lever 12 has a slit 27 disposed at the upper portion thereof for selectively engaging one of a plurality of knots 26 disposed at one end of the string 25 which connects the mouth to the pivotal plate lever. The string 25 which can be made of NYLON® is fixed to a throat connector 23 at the end of the string 25 opposite to the knots. The pivotal plate lever 12 has a rectangular opening 42 for slidably receiving the middle extension 27 so that it can freely move in the rectangular opening 42 when the user squeezes the pivotal plate lever 12 (FIG. 3).

Figure 4:
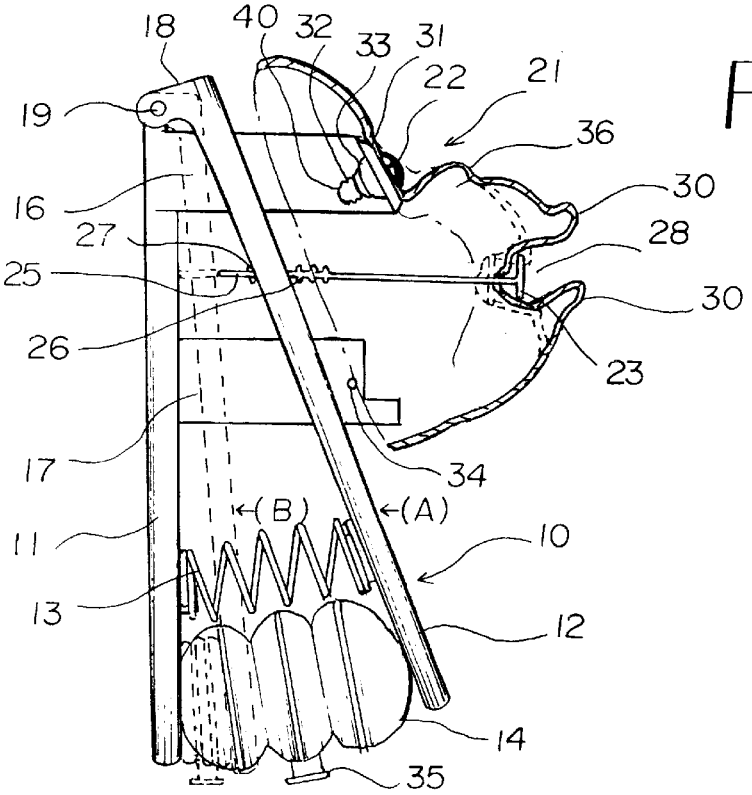
FIG. 4 is a side view of the operating device of FIG. 2 showing how the movement of the mouth and the sounds of a squeaker are produced by squeezing or pushing the abdomen of the animated toy doll, according to the present invention.

As shown in FIG. 4, the animated toy doll according to the present invention operates as follows. When the user pushes or squeezes the abdomen of the monkey toy doll 41, that is, the pivotal plate lever 12 is pushed in the direction indicated by the arrow (A) against the bias produced by spring 13, the pivotal plate lever 12 moves toward the base lever 11 as shown by the dotted pivotal plate lever 11 in the direction indicated by the arrow (B).

At this time, the string 25 pulls back the throat connector 23 so that the pair of lips, which are made of a soft vinyl material, can move from an open to a closed position and simultaneously the squeaker 14 produces a squeaky sound through the sound-creating device 35. Thereafter, by releasing the levers, the pivotal plate lever 12 returns to its original position, whereby the pair of lips 30 returns to is open position and the squeaky sound is terminated.

Accordingly, the toy doll according to the present invention is simple in structure and easy to use and inexpensive to manufacture. That is, by using the flexibility of soft vinyl for the face member 21, movement of muscles, such as the lips 30, can be achieved when compared with the conventional animated toy doll which is complicated in structure, expensive to manufacture and difficult to use.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An animated toy doll having a substantially hollow head and an adjoining body, said head containing external facial features which include a mouth, said animated toy doll housing an operating device which comprises a pair of levers which are hinged together at one end portion thereof and held apart at the other end portion thereof by a biasing spring means, and connecting means extending from said one end portion of said pair of levers to the vicinity of the mouth of the doll, the connecting means pulling against the mouth upon compressing the pair of levers against the bias of the spring thereby causing a tension in said connecting means and desired change of expression in the facial features, and upon releasing the pair of levers, the connecting means is released from a taut state thereby releasing the tension in said connecting means and the desired change in expression in the facial features.

2. The animated toy doll of claim 1, wherein the mouth is provided with external lips, and the connecting means is attached to the rear of the mouth, whereby upon the compression of said levers, the lips move from an open to a closed position.

3. The animated toy doll of claim 1, wherein the connecting means is a string member.

4. The toy doll of claim 1, wherein a sound-producing device extends between said pair of levers at said other end portions thereof whereby upon compressing the pair of levers against the bias of the spring, a sound is produced.

5. The toy doll of claim 4, wherein the sound-producing device is a bellows-type structure containing said sound-producing device.

6. The animated toy doll of claim 4, wherein said one end portion of the levers is disposed in the hollow head and said other end portions extend into said adjoining body, whereby upon squeezing the body of the toy doll, the desired sound and facial changes are achieved.

7. The animated toy doll of claim 1, wherein at least a portion of the connection means extends through an opening formed in the rear of the mouth of the doll.

8. The animated toy doll of claim 7, wherein said portion of said connecting means which extends through said opening has an impediment means attached thereto, said impediment means having a size greater than said opening, thereby preventing movement thereof therethrough.

* * * * *